US009753483B1

(12) United States Patent
Thomas et al.

(10) Patent No.: US 9,753,483 B1
(45) Date of Patent: Sep. 5, 2017

(54) CLICK KNOB ASSEMBLY

(71) Applicant: KRUGER OPTICAL, INC., Tigard, OR (US)

(72) Inventors: Mark A. Thomas, Sisters, OR (US); Neil Mai, Beaverton, OR (US)

(73) Assignee: KRUGER OPTICAL, INC., Tigard, OR (US)

( * ) Notice: Subject to any disclaimer, the term of this patent is extended or adjusted under 35 U.S.C. 154(b) by 42 days.

(21) Appl. No.: 14/744,488

(22) Filed: Jun. 19, 2015

(51) Int. Cl.
*G05G 1/10* (2006.01)
*G05G 5/03* (2008.04)
*F41G 1/38* (2006.01)

(52) U.S. Cl.
CPC ..... *G05G 5/03* (2013.01); *F41G 1/38* (2013.01); *G05G 1/10* (2013.01)

(58) Field of Classification Search
CPC .. G05G 1/08; G05G 1/10; G05G 1/38; G05G 5/03; G05G 5/06; G05G 5/065; F41G 1/18; F41G 1/20; F41G 1/38; H01H 3/08; H01H 3/50; H01H 19/14
See application file for complete search history.

(56) References Cited

U.S. PATENT DOCUMENTS 3,910,308 A * 10/1975 Mack ..... F16K 31/60 116/277
5,606,155 A * 2/1997 Garcia ..... H01H 19/04 200/11 K
6,281,453 B1 * 8/2001 Uleski ..... B60Q 1/0076 200/336
6,578,447 B1 * 6/2003 Fraser ..... G05G 5/06 200/565
6,643,970 B2 11/2003 Huber
7,415,791 B2 8/2008 Williams, III et al.
7,640,830 B2 1/2010 Bonis
8,166,696 B2 5/2012 Hamilton
8,806,798 B2 * 8/2014 Crispin ..... F41G 1/38 42/119
8,848,287 B2 9/2014 Schmitt et al.
8,910,542 B2 * 12/2014 Klimecki ..... G05G 1/105 200/316
8,919,026 B2 * 12/2014 Hamilton ..... F41G 1/38 356/247
8,984,796 B2 3/2015 Thomas et al.
9,188,408 B2 * 11/2015 Huynh ..... F41G 1/22
2010/0175298 A1 7/2010 Thomas et al.
(Continued)

*Primary Examiner* — Adam D Rogers
(74) *Attorney, Agent, or Firm* — Timothy E. Siegel Patent Law, PLLC; Timothy E. Siegel

(57) ABSTRACT

A click knob assembly that has a fixture having a circular inner surface defining uniformly spaced ridges separated by grooves and a knob, set in the fixture, and including a user accessible portion; a spring holder, attached to the user accessible portion; a spring assembly, engaged to the spring holder; and a first plunger and a second plunger engaged to the spring holder, each facing the circular inner surface, in opposed direction to each other, and each being pushed outwardly by the spring assembly, and thereby being pressed into the circular inner surface. The first plunger includes a click surface sized and positioned to engage the uniformly spaced grooves. When the knob is rotated, the click surface is pushed over a ridge, and then falls into a groove, making a click sound and both the plungers are maintained in contact to the circular inner surface by the spring assembly.

4 Claims, 4 Drawing Sheets

(56) References Cited

U.S. PATENT DOCUMENTS

| | | | | |
|---|---|---|---|---|
| 2013/0167425 | A1 | 7/2013 | Crispin | |
| 2014/0196351 | A1 | 7/2014 | Campean | |
| 2015/0159747 | A1* | 6/2015 | Hoskins | F16H 59/0217 74/473.23 |

* cited by examiner

CLICK KNOB ASSEMBLY

BACKGROUND

In many devices, a knob assembly that produces "clicks" during knob rotation is used to provide auditory feedback to a user. In the instance of the elevation and windage assemblies on a rifle scope, the auditory feedback provided by the clicks produced by knob rotation is of particular importance. In many instances, a shooter cannot take his eye from the eyepiece to visually track how much he is turning one of these adjustment knobs, but counts the clicks. At nighttime, it may be too dark for a visual reading, forcing a complete reliance on click counting.

The design of click knobs offers some challenges to the mechanical designer. The current design uses one wheel that turns inside and is pressed against a circular inner surface. Achieving roundness and concentricity sufficient to prevent varying resistance to knob rotation has proven elusive, giving click knobs made according to this design an inconsistent resistance to being turned over the course of a complete rotation, which may elicit a negative response from users.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

A click knob assembly that has a fixture having a circular inner surface defining uniformly spaced ridges separated by uniformly spaced grooves and a knob, set in the fixture, and including a user accessible portion; a spring holder, attached to the user accessible portion; a spring assembly, engaged to the spring holder; and a first plunger and a second plunger engaged to the spring holder, each facing the circular inner surface, in opposed direction to each other, and each being pushed outwardly by the spring assembly, and thereby being pressed into the circular inner surface. The first plunger includes a click surface sized and positioned to engage the uniformly spaced grooves. When the knob is rotated, the click surface is pushed over a ridge, and then falls into a groove, making a click sound and both the plungers are maintained in contact to the circular inner surface by the spring assembly.

A rifle scope, that has a housing, a click knob assembly; and an erector tube, mounted in the housing such that its orientation can be changed by rotation of the click knob assembly. The click knob assembly includes a fixture having a circular inner surface defining uniformly spaced ridges separated by uniformly spaced grooves; and a knob, including: a user accessible portion; a spring holder, attached to the user accessible portion; a spring assembly, engaged to the spring holder; and a first plunger and a second plunger engaged to the spring holder, each facing the circular inner surface, in opposed direction to each other, and each being pushed outwardly by the spring assembly, and thereby being pressed into the circular inner surface, the first plunger including a click surface sized and positioned to engage the uniformly spaced grooves. Further, the knob includes a push surface and is engaged to the fixture by helical threads, so that when the knob is rotated, the click surface is pushed over a ridge, and then falls into a groove, making a click sound and both the plungers are maintained in contact to the circular inner surface by the spring assembly and wherein the rotatable subassembly is translated by the helical threads and the push surface pushes against the erector tube, changing its orientation.

In addition to the exemplary aspects and embodiments described above, further aspects and embodiments will become apparent by reference to the drawings and by study of the following detailed descriptions.

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Figure 1:
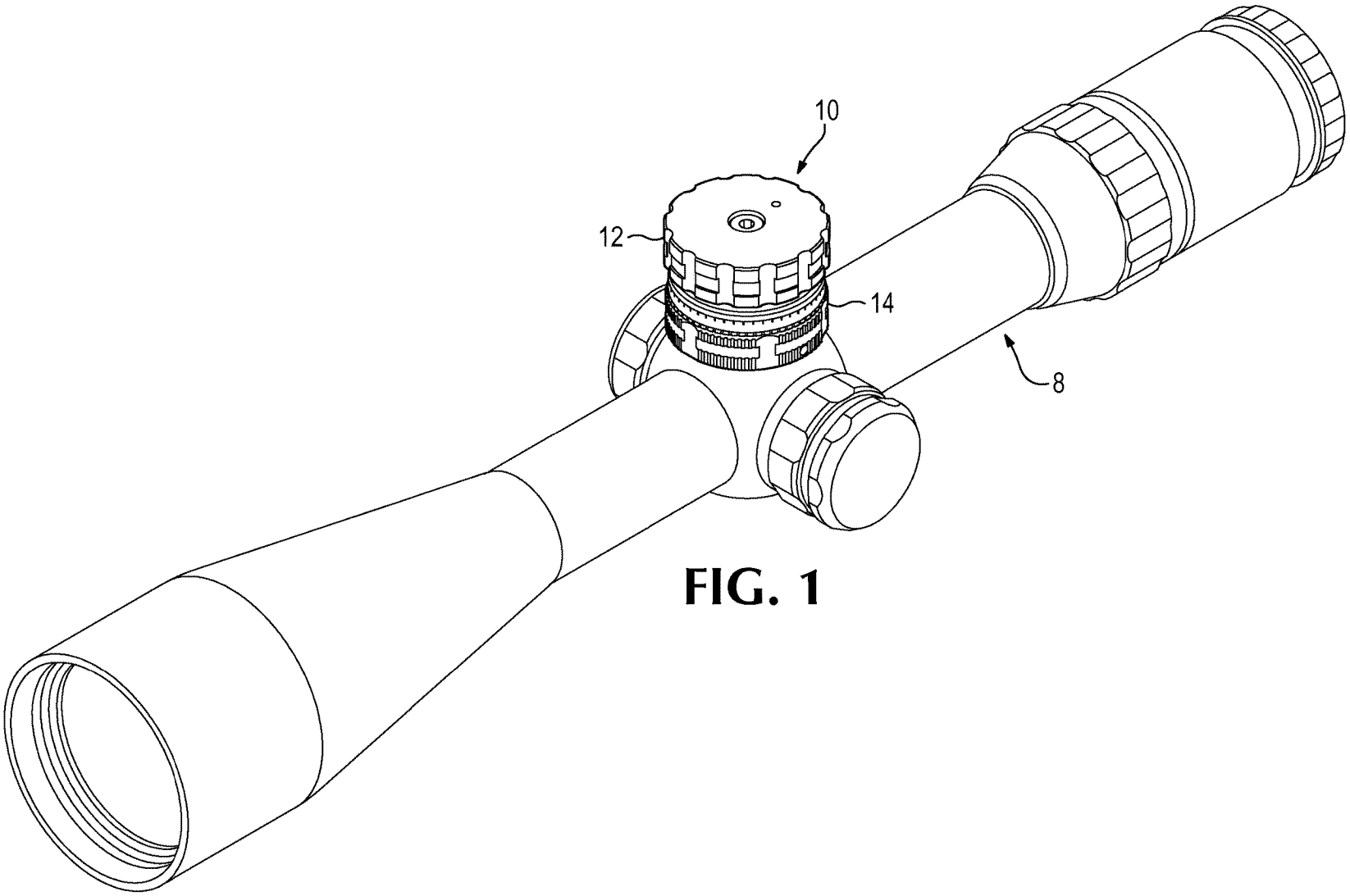
FIG. 1 is a top isometric view of a rifle scope, having an elevation knob assembly, which is also a click knob assembly.
Figure 2:
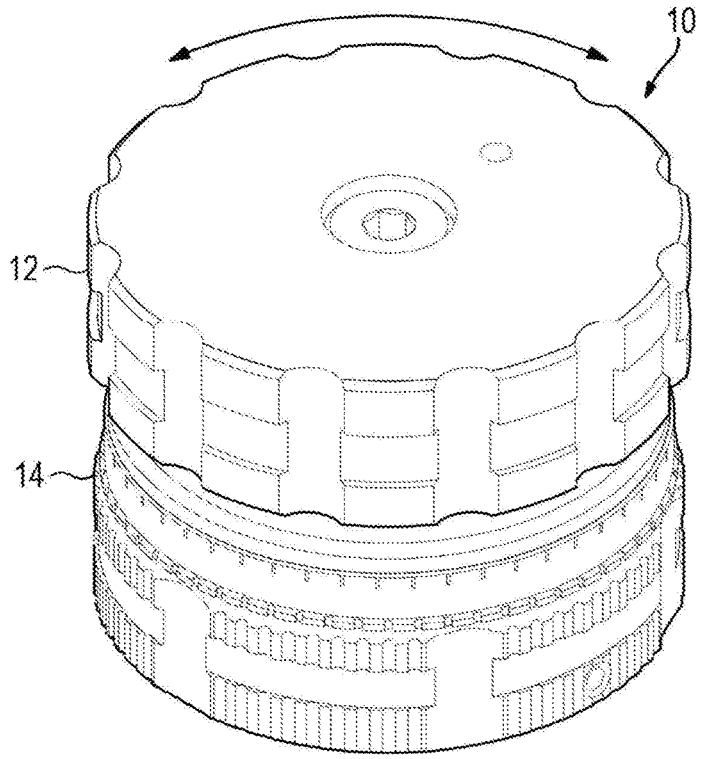
FIG. 2 is a top side isometric view of the click knob of FIG. 1.

Referring to FIG. 1 a typical rifle scope 8 includes click knob assemblies 10 for adjustment of elevation and windage. Each click knob assembly 10 includes a knob 12 and a stationary fixture 14. It is typical, although not shown in FIG. 1 to have indicia printed on knob 12 or fixture 14 or both, to inform a user of the degree to which knob 12 has been turned, relative to some zero point. Unfortunately, this can only inform a user of the degree to which knob 12 has been turned during a single rotation, as assemblies, such as assembly 10 are frequently configured to permit more than one complete rotation of a knob, such as knob 12.

Figure 3:
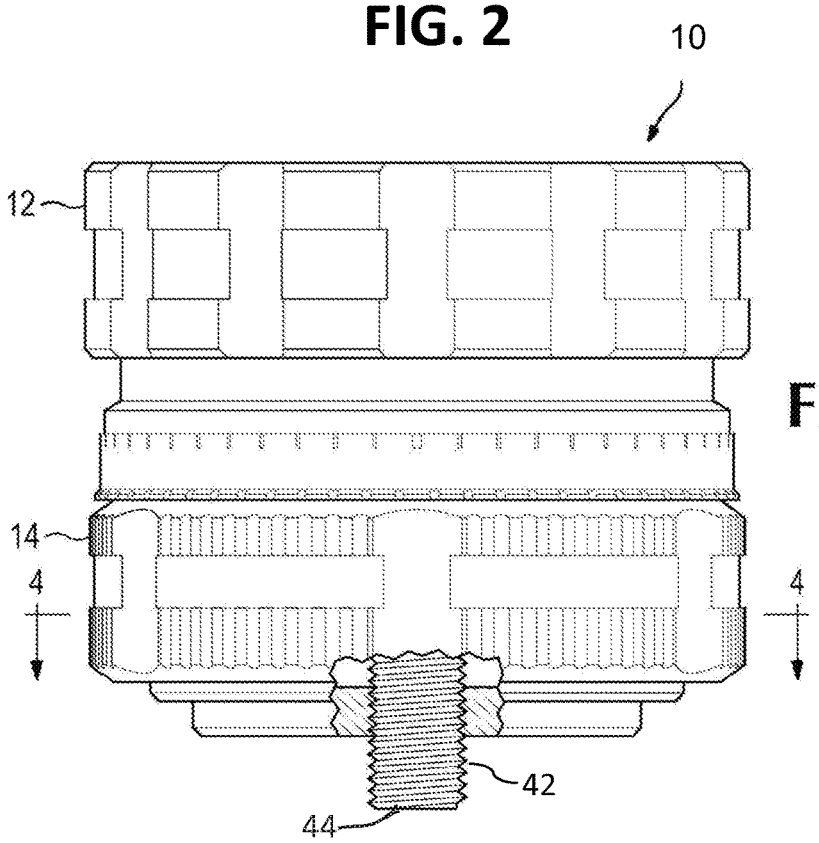
FIG. 3 is a side view of the click knob assembly of FIG. 1.

As indicated in FIG. 3, a generally round spring holder 18, that is a part of knob 12 extends into area that is enclosed within a circular inner surface 16 of fixture 14. Surface 16 includes evenly spaced grooves 20 and ridges 22. Although fifty grooves 20 are shown for ease of presentation, it is typical to have between 60 and 100 grooves 20 (and an equal number of ridges 22). A through-hole 30 is formed through spring holder 18, into which is set a click plunger 32, which defines a rounded click surface 34, and a riding plunger 33 having a riding surface 40 that forms an arc having a radius matching that of circular inner surface 16. Both plungers 32 and 33 are urged outwardly by a spring 36 (which may be termed a "spring assembly"), held in compression and holding a plunger shaft 38, for both plungers 32 and 33.

Accordingly, in contrast to the prior art designs, the round surface of spring holder 18 is not pushed against surface 16, and need not touch surface 16. In an alternative preferred embodiment, spring holder 18 is not round and may even be in the shape of sleeve about, and retaining, spring 36. Surface 40 is pressed against surface 16, but because surface 40 is far smaller than the surface of element 18, there is virtually no chance that imperfections in the shape of surface 40 or surface 16 will cause an inconsistency of required turning force for knob 12. As knob 12, and thereby spring holder 18 is rotated, surface 34 rides over a ridge 22 and then falls into the next groove 20, making a click sound.

The knob assembly 10 includes a push surface 44 and is engaged to the fixture by helical threads 42. Skilled persons will readily recognize that the helical threads and push surface shown are necessary parts of an elevation knob.

In an additional advantage, the structure of surface 34 is integral to the plungers 32, thereby avoiding another problem encountered in the prior art, that of the click balls, which played the same role as surfaces 34 but being a separate part, flying off during manufacturing or maintenance. In general it was very difficult to work with such a tiny part, especially one that was spring-loaded.

Figure 4:
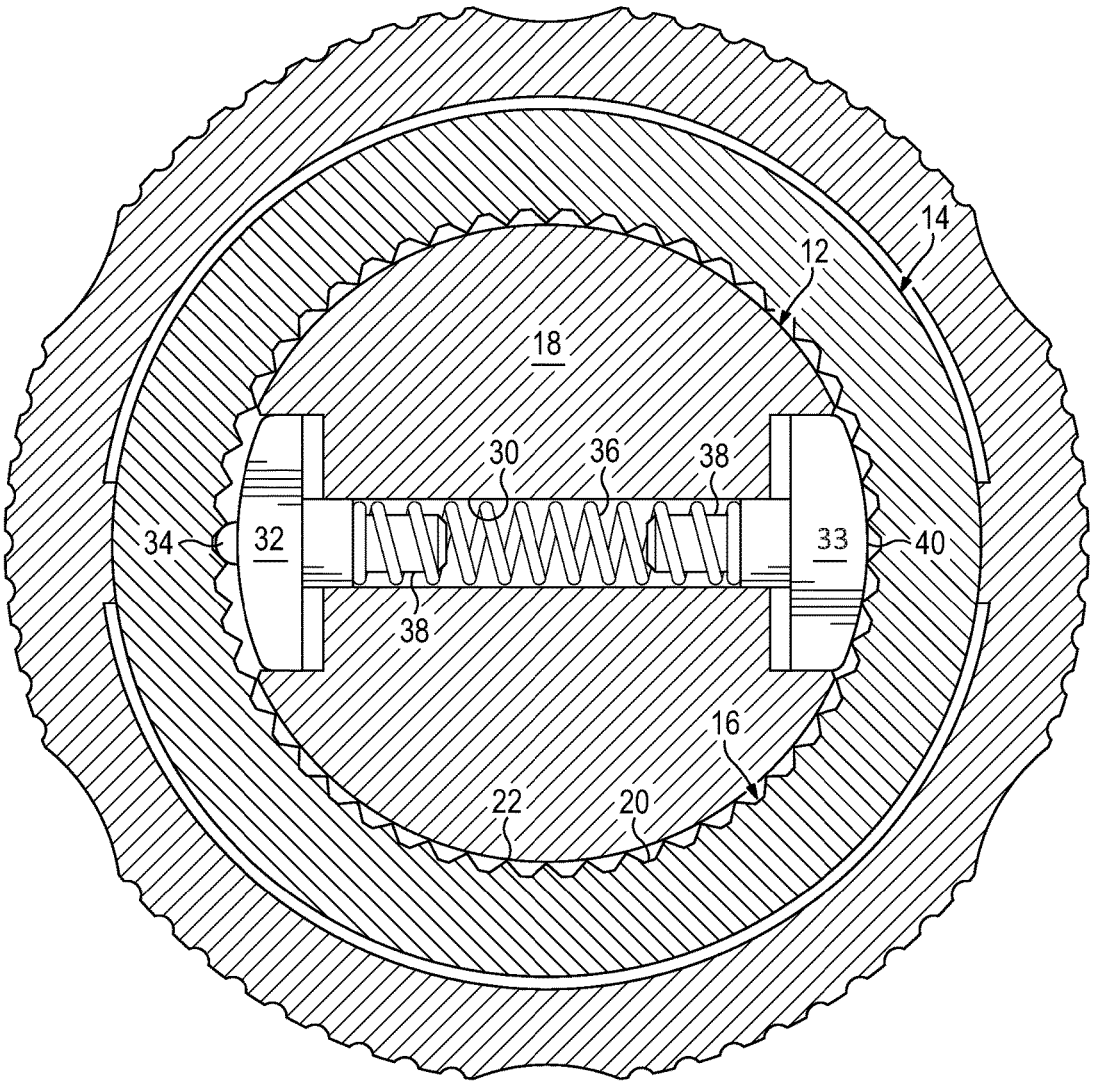
FIG. 4 is a sectional view of the click knob assembly of FIG. 1, taken along line 4-4 of FIG. 3, and showing a knob assembly interior according to the present invention.
Figure 5:
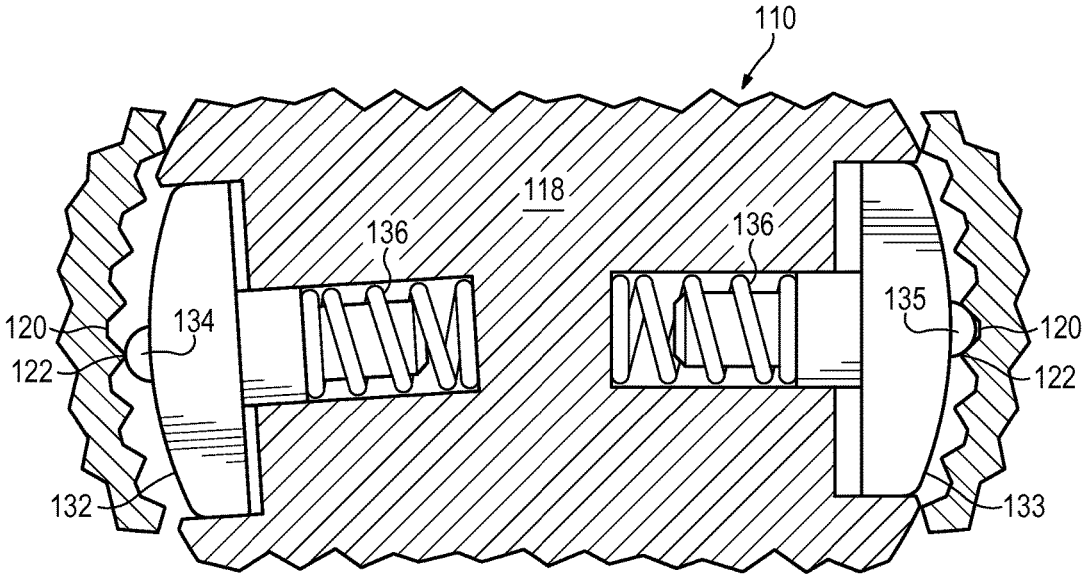
FIG. 5 is a sectional view, taken along line 3-3 of FIG. 2, but showing a different interior than that shown in FIG. 3, according to an alternative embodiment of the present invention.
Figure 6:
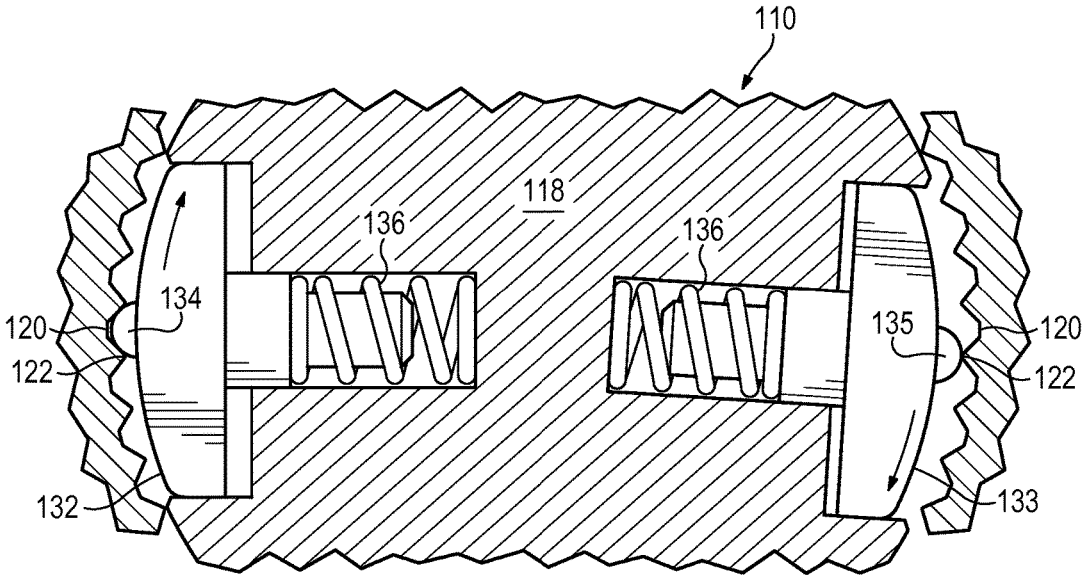
FIG. 6 is the sectional view of FIG. 5, but showing a different knob rotational position.

Referring to FIGS. 4 and 5, in an alternative preferred embodiment of a click knob assembly 110, having a spring holder accommodating two plungers 132 and 133, have a click surface 134 and 135, respectively. Surfaces 134 and 135 are slightly displaced from each other so that when a surface 134 is on a ridge 122, surface 135 is in a groove 120. Two springs, 136 push outwardly on plungers 132 and 133, forming a spring assembly of a different form from that of the previous embodiment. Accordingly, when knob 112 is moved by the rotational distance equal to the spacing between two adjacent grooves 120, two click sounds are produced, thereby increasing the precision of possible adjustment, when relying entirely on clicks. In an additional preferred embodiment, a single spring 136 is fit into a single through hole, which undergoes a slight bend, but is still straight enough so that a single spring also bends within through hole to push both plungers 132 and 133.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A click knob assembly, comprising:
   a. a fixture having a circular inner surface defining uniformly spaced ridges separated by uniformly spaced grooves; and
   b. a knob, set in said fixture, and including:
      i. a user accessible portion;
      ii. a spring holder, attached to said user accessible portion;
      iii. a spring assembly, engaged to said spring holder; and
      iv. a first plunger and a second plunger engaged to said spring holder, each facing said circular inner surface, in opposed direction to each other, and each being pushed outwardly by said spring assembly, and thereby being pressed into said circular inner surface, said first plunger including a first click surface and said second plunger including a second click surface, each click surface sized and positioned to engage said uniformly spaced grooves, said first plunger and said second plunger being offset so that when said click surface of said first plunger is in one of said uniformly spaced grooves, said click surface of said second plunger is on one of said uniformly spaced ridges;
   c. whereby when said knob is rotated, in alternating sequence, said first click surface is pushed over one of said uniformly spaced ridges, and then falls into one of said uniformly spaced grooves, making a click sound and then said second plunger is pushed over one of said uniformly spaced ridges, and then falls into one of said uniformly spaced grooves, making a click sound, so that as said knob is rotated, two click sounds are produced for each ridge passed by said first click surface, and both said plungers are maintained in contact to said circular inner surface by said spring assembly.

2. A rifle scope, comprising:
   a. a housing;
   b. a click knob assembly;
   c. an erector tube, mounted in said housing such that the orientation of said erector tube can be changed by rotation of said click knob assembly;
   d. said click knob assembly including:
      i. a fixture having a circular inner surface defining uniformly spaced ridges separated by uniformly spaced grooves; and
      ii. a knob, including: a user accessible portion; a spring holder, attached to said user accessible portion; a spring assembly, engaged to said spring holder; and a first plunger and a second plunger engaged to said spring holder, each facing said circular inner surface, in opposed direction to each other, and each being pushed outwardly by said spring assembly, and thereby being pressed into said circular inner surface, said first plunger including a click surface sized and positioned to engage said uniformly spaced grooves further, wherein said second plunger includes a riding surface, facing said circular inner surface and being in the shape of an arc; and
      iii. wherein said knob includes a push surface and is engaged to said fixture by helical threads; and
   e. whereby when said knob is rotated, said click surface is pushed over one of said uniformly spaced ridges, and then falls into one of said uniformly spaced grooves, making a click sound and both the first plunger and the second plunger are maintained in contact to said circular inner surface by said spring assembly and wherein said click knob assembly is translated by said helical threads and said push surface pushes against said erector tube, changing the orientation of said erector tube.

3. The rifle scope assembly of claim 2, wherein said arc has the same radius as does said circular inner surface.

4. The rifle scope assembly of claim 2, wherein said second plunger has a second click surface, and wherein said second plunger is offset from said first plunger so that when said first click surface is centered in one of said uniformly spaced grooves, said second click surface is centered on one of said uniformly spaced ridges, so that as said click knob is rotated, two click sounds are produced for each ridge passed by said first click surface.

* * * * *